US010374317B2

(12) United States Patent
Cheung et al.

(10) Patent No.: US 10,374,317 B2
(45) Date of Patent: Aug. 6, 2019

(54) EXPONENTIALLY TAPERED SLOT ANTENNA AND ASSEMBLY

(71) Applicant: BAE SYSTEMS INFORMATION AND ELECTRONIC SYSTEMS INTEGRATION INC., Nashua, NH (US)

(72) Inventors: Christopher K. Cheung, Newton, MA (US); Dean W. Howarth, Sudbury, MA (US); Michael J. O'Brien, Nashua, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 49 days.

(21) Appl. No.: 15/625,206

(22) Filed: Jun. 16, 2017

(65) Prior Publication Data

US 2018/0366830 A1 Dec. 20, 2018

(51) Int. Cl.

| | |
|---|---|
| ***H01Q 13/08*** | (2006.01) |
| ***H01Q 1/52*** | (2006.01) |
| ***H01Q 1/38*** | (2006.01) |
| ***H01Q 3/26*** | (2006.01) |
| ***H01Q 21/20*** | (2006.01) |
| ***H01Q 21/24*** | (2006.01) |

(52) U.S. Cl.

CPC ..... *H01Q 13/085* (2013.01); *H01Q 1/38* (2013.01); *H01Q 1/526* (2013.01); *H01Q 3/26* (2013.01); *H01Q 21/20* (2013.01); *H01Q 21/24* (2013.01)

(58) Field of Classification Search

CPC .... H01Q 13/085; H01Q 13/10; H01Q 21/064; H01Q 15/14; H01Q 13/18; H01Q 19/10

See application file for complete search history.

(56) References Cited

U.S. PATENT DOCUMENTS

| | | | | |
|---|---|---|---|---|
| 6,043,785 | A | 3/2000 | Marino | |
| 6,147,572 | A * | 11/2000 | Kaminski | H01P 1/20 333/134 |
| 6,850,203 | B1 * | 2/2005 | Schuneman | H01Q 13/085 343/767 |
| 7,088,300 | B2 | 8/2006 | Fisher | |
| 8,269,685 | B2 | 9/2012 | McQuaid et al. | |
| 8,279,128 | B2 | 10/2012 | McQuaid et al. | |

(Continued)

OTHER PUBLICATIONS

Milligan, Thomas A., "Modern Antenna Design," Second Edition, IEEE Press, Copyright 2005, pp. 513-514.

*Primary Examiner* — Ricardo I Magallanes

(74) *Attorney, Agent, or Firm* — Sand, Sebolt & Wernow LPA; Scott J. Asmus; Sarah B. Kim

(57) ABSTRACT

An exponentially tapered slot antenna assembly includes a plurality of antenna panels arranged together in a general box-like configuration. At each corner of the box-like configuration, a capacitive load panel is in operative electrical communication with orthogonal pairs of antenna panels. Each antenna panel defines an inner and outer surface and has an electromagnetic interference shielding material positioned thereon. The shielding material positioned may be positioned near a first or upper edge of each antenna panel of the assembly. It has been empirically determined that this configuration enables an operational bandwidth that is greater than 5:1 and a voltage standing wave ratio that is less than 3:1 over the 5:1 bandwidth.

12 Claims, 10 Drawing Sheets

(56) References Cited

U.S. PATENT DOCUMENTS

| | | | | |
|---|---|---|---|---|
| 2010/0171673 | A1* | 7/2010 | Guy | H01Q 13/085 343/753 |
| 2011/0057852 | A1* | 3/2011 | Holland | H01Q 9/28 343/795 |
| 2013/0038495 | A1* | 2/2013 | Benzel | H01Q 13/085 343/770 |
| 2014/0197995 | A1* | 7/2014 | Lu | H01Q 1/38 343/700 MS |
| 2017/0093010 | A1* | 3/2017 | Herbsommer | H01Q 19/10 |
| 2017/0302003 | A1* | 10/2017 | Elsallal | H01Q 21/064 |

* cited by examiner

EXPONENTIALLY TAPERED SLOT ANTENNA AND ASSEMBLY

BACKGROUND

Technical Field

The present disclosure relates generally to slot antennas. More particularly, the present disclosure relates to an exponentially tapered slot antenna assembly. Specifically, the present disclosure relates to an exponentially tapered slot antenna assembly having capacitively loaded panels and electromagnetic interference shielding material.

Background Information

Tapered slot antennas have been in use extensively as linear polarized radiators. In most applications, linearly tapered slot antennas or exponentially tapered slot antennas, commonly known as notch antennas or Vivaldi antennas, are used. Typically, the Vivaldi antenna includes an exponentially tapered slot formed near a dielectric substrate, defined by two opposite members of a metallized layer on one side of the substrate. A feedline is a narrow conductor located on the other side of the substrate, crossing over a extended portion of the slotline, typically at right angles, forming a balun. One exemplary disadvantage of the Vivaldi configuration is that the return loss performance does not meet the requirements of today's broadband communication applications.

SUMMARY

In recent years, there has been a demand on broadband antenna arrays to be used in cellular telephones or other communication devices. Thus, it is advantageous to provide an improved Vivaldi or Exponentially Tapered Slot Antenna (ETSA).

In one aspect, an exemplary embodiment of the present disclosure may provide an antenna assembly comprising: a first exponentially tapered slot antenna (ETSA) including an exponentially tapered edge on a radiating element positioned between a substrate and a superstrate collectively defining a first antenna panel including a first end and a second end; a second ETSA including an exponentially tapered edge of a radiating element positioned between a substrate and a superstrate collectively defining a second antenna panel including a first end and a second end; a first corner formed by an orthogonal alignment of the first end of the first antenna panel with the second end of the second antenna panel; a first capacitive loaded panel adjacent the first corner in operative electrical communication with the first ETSA and the second ETSA. This embodiment or another exemplary embodiment may further include a first angle formed between the first capacitive loaded panel and the first antenna panel; a second angle formed between the first capacitive loaded panel and the second antenna panel; and wherein the first angle and the second angle are both 45°. This embodiment or another exemplary embodiment may further include a first angle formed between the first capacitive loaded panel and the first antenna panel; a second angle formed between the first capacitive loaded panel and the second antenna panel; and wherein the first angle is greater than the second angle.

This embodiment or another exemplary embodiment may further include a first electromagnetic interference (EMI) shielding material positioned along a first major surface of the first antenna panel. This embodiment or another exemplary embodiment may further include a second EMI shielding material positioned along an opposite second major surface of the first antenna panel. This embodiment or another exemplary embodiment may further include wherein the first and second EMI are positioned over a wider first end of the exponentially tapered edge.

This embodiment or another exemplary embodiment may further include a third ETSA including an exponentially tapered edge on a radiating element positioned between a substrate and a superstrate collectively defining a third antenna panel including a first end and the second end; the third antenna panel offset parallel to the first antenna panel; a second corner formed by an orthogonal alignment of the first end of the second antenna panel with the second end of the third antenna panel; and a second capacitive loaded panel adjacent the second corner in operative electrical communication with the second ETSA and the third ETSA. This embodiment or another exemplary embodiment may further include a fourth ETSA including an exponentially tapered edge on a radiating element positioned between a substrate and a superstrate collectively defining a fourth antenna panel including a first end and the second end; the fourth antenna panel offset parallel to the second antenna panel; a third corner formed by an orthogonal alignment of the first end of the third antenna panel with the second end of the fourth antenna panel; a third capacitive loaded panel adjacent the third corner in operative electrical communication with the third ETSA and the fourth ETSA; a fourth corner formed by an orthogonal alignment of the second end of the first antenna panel with the first end of the fourth antenna panel; and a fourth capacitive loaded panel adjacent the fourth corner in operative electrical communication with the first ETSA and the fourth ETSA.

This embodiment or another exemplary embodiment may further include wherein the orthogonal alignments of the first, second, third, and fourth antenna panels define an open box-like antenna structure including a collective outer surface and a collective inner surface; and a first electromagnetic interference (EMI) shielding material positioned along at least a portion of the collective outer surface. This embodiment or another exemplary embodiment may further include a second EMI shielding material positioned along at least a portion of the collective inner surface. This embodiment or another exemplary embodiment may further include an operational bandwidth of the open box-like antenna structure that is at least 5 to 1 (5:1); and a Voltage Standing Wave Ratio (VSWR) of the open box-like antenna structure that is less than 3:1 over the at least 5:1 bandwidth. This embodiment or another exemplary embodiment may further include wherein an instantaneous bandwidth is equal to the operational bandwidth. This embodiment or another exemplary embodiment may further include wherein the open box-like antenna structure has dimensions in the following ranges: a length less than about 20 inches, a width less than about 20 inches, and a height less than about 15 inches. This embodiment or another exemplary embodiment may further include wherein the first antenna panel and the second antenna panel form an orthogonal pair and when the first and second antenna panels are fed with a ±90° phase difference, the first ETSA and the second ETSA respectively form either right hand or left hand circular polarization. This embodiment or another exemplary embodiment may further include wherein each of the four capacitive loaded panels is square shaped with dimensions in a range from about 6"×6" to about 12"×12".

In accordance with one aspect, an exemplary embodiment of the present disclosure may provide an exponentially tapered slot antenna comprising: a radiating element including an exponentially tapered edge extending from a wider first end to a narrower second end, and a slot formed near the second end of the exponentially tapered edge, and a stub formed near the slot; a substrate positioned along a first major surface of the radiating element; a superstrate positioned along an opposite second major surface of the radiating element; a first electromagnetic interference (EMI) shielding material positioned along an outer surface of the substrate. This example, or another example may further include a second EMI shielding material positioned along an outer surface of the superstrate. This example, or another example may further include wherein the first and second EMI shielding material are positioned over the wider first end of the exponentially tapered edge. This example, or another example may further include wherein the first and second EMI shielding material are positioned over the the exponentially tapered edge intermediate the first end and the second end. This example, or another example may further include wherein the first and second EMI shielding material are positioned over the slot and stub proximate the narrower second end of the exponentially tapered edge.

In another aspect, an embodiment of the present disclosure provides a capacitive loaded, dielectrically enhanced, exponentially tapered slot antenna (i.e., an improved Vivaldi antenna) that provides an operational bandwidth that is greater than 5 to 1 while residing in a space constrained environment. It exhibits a Voltage Standing Wave Ratio, VSWR, that is less than 3:1 over the 5 to 1 bandwidth with an instantaneous bandwidth equal to the operational bandwidth. One exemplary implementation includes four radiating elements with the capacitive loads and is 15.5 inches in length, 15.5 inches wide and 9 inches high. The small size of this antenna enables it to be used in applications where the environment does not allow a more conventional element with the same bandwidth. In one example, the antenna is assembled in a quad element configuration. Each of the notch radiators (i.e., the ETSA radiating assembly) may be 11 inches wide by 9 inches high. The capacitive loads are 9 inches wide by 9 inches high. These capacitively loaded panels allow the exponentially notched radiating elements to radiate at a lower frequency. The conducting radiating elements are sandwiched between a high dielectric constant substrate and superstrate to further lower the operating frequency. The quad element configuration provides a basic building block that can be used as a stand-alone antenna or can be incorporated in array application where higher gain is desired. Two adjacent sides form an orthogonal pair and when fed with a ±90° phase difference the two elements form either right hand or left hand circular polarization as desired. Forming the basic building block with four elements exploits the effects of mutual coupling to further the frequency. Additionally, sheets of the high permeable material, when placed at judicious locations (i.e., empirically determined) on the radiating elements, enhance performance at lower frequencies. In this configuration the material resides in the region above the throat of the exponentially tapered notch. The particular material incorporated is a radar absorbing material at higher frequencies. The material additionally improves the VSWR at lower frequencies without seriously degrading gain performance in the operating band of interest.

In another aspect, an embodiment of the present disclosure may provide an exponentially tapered slot antenna comprising: a radiating element including an exponentially tapered edge extending from a wider first end to a narrower second end, and a slot formed near the second end of the exponentially tapered edge, and a stub formed near the slot; a dielectric substrate positioned along a first major surface of the radiating element; a dielectric superstrate positioned along an opposite second major surface of the radiating element; a first electromagnetic interference (EMI) shielding material positioned along an outer surface of the substrate. This embodiment or another exemplary embodiment may further include a second EMI shielding material positioned along an outer surface of the superstrate. This embodiment or another exemplary embodiment may further include wherein the first and second EMI shielding material are positioned over the wider first end of the exponentially tapered edge. This embodiment or another exemplary embodiment may further include wherein the first and second EMI shielding material are positioned over the exponentially tapered edge intermediate the first end and the second end. This embodiment or another exemplary embodiment may further include wherein the first and second EMI shielding material are positioned over the slot and stub proximate the narrower second end of the exponentially tapered edge. This embodiment or another exemplary embodiment may further include a capacitive loaded panel arranged at a 45° angle relative to the radiating element and in operative communication therewith.

In yet another aspect, an exemplary embodiment of the present disclosure may provide an antenna assembly comprising: a first exponentially tapered slot antenna (ETSA) including an exponentially tapered edge of a radiating element positioned between a substrate and a superstrate collectively defining a first antenna panel including a first edge and the second edge; a second ETSA including an exponentially tapered edge of a radiating element positioned between a substrate and a superstrate collectively defining a second antenna panel including a first edge and the second edge; a first corner union formed by an orthogonal connection of the first edge of the first antenna panel to the second edge of the second antenna panel; a first capacitive loaded panel connected to the first corner union in operative communication with the first ETSA and the second ETSA. This example or another example may further provide a first angle formed between the first capacitive loaded panel and the first antenna panel; a second angle formed between the first capacitive loaded panel and the second antenna panel; and wherein the first angle and the second angle are both 45°. Another example may further provide a first angle formed between the first capacitive loaded panel and the first antenna panel; a second angle formed between the first capacitive loaded panel and the second antenna panel; and wherein the first angle is greater than the second angle.

This example or another example of the antenna assembly may further provide a third ETSA including an exponentially tapered edge positioned between a substrate and a superstrate collectively defining a third antenna panel including a first edge and the second edge; the third antenna panel offset parallel to the first antenna panel; a second corner union formed by an orthogonal connection of the first edge of the second antenna panel to the second edge of the third antenna panel; and a second capacitive loaded panel connected to the second corner union in operative communication with the second ETSA and the third ETSA. This example or another example may further provide a fourth ETSA including an exponentially tapered edge positioned between a substrate and a superstrate collectively defining a third antenna panel including a first edge and the second edge; the fourth antenna panel offset parallel to the second antenna panel; a third corner union formed by an orthogonal connection of the first edge of the third antenna panel to the second edge of the fourth antenna panel; a third capacitive loaded panel connected to the third corner union in operative communication with the third ETSA and the fourth ETSA; a fourth corner union formed by an orthogonal connection of the second edge of the first antenna panel to the first edge of the fourth antenna panel; a fourth capacitive loaded panel connected to the fourth corner union in operative communication with the first ETSA and the fourth ETSA. This example or another example may further provide a wherein the orthogonal connection of the first, second, third, and fourth antenna panels defines an open box-like antenna structure including a collective outer surface and a collective inner surface; and a first electromagnetic interference (EMI) shielding material positioned along at least a portion of the collective outer surface.

In yet another aspect, an example in accordance with the present disclosure may provide a tapered slot antenna comprising: a radiating element including a tapered edge extending from a wider first end to a narrower second end, and a slot formed near the second end of the tapered edge, and a stub formed near the slot, and an upper edge of the radiating element near the wider first end; and a panel in electrical communication with the radiating element at or near the upper edge establishing a capacitive load on the radiating element when the radiating element is fed with current.

In yet another aspect, an example in accordance with the present disclosure may provide a tapered slot antenna comprising: a radiating element including a tapered edge extending from a wider first end to a narrower second end, and a slot formed near the second end of the tapered edge, and a stub formed near the slot; a dielectric substrate positioned along a first major surface of the radiating element; a first electromagnetic interference (EMI) shielding material positioned along the substrate opposite the radiating element. This example may further include a dielectric superstrate positioned along an opposite second major surface of the radiating element; and a second EMI shielding material positioned along the substrate opposite the radiating element.

In yet another aspect, an exponentially tapered slot antenna assembly includes a plurality of antenna panels arranged together in a general box-like configuration. At each corner of the box-like configuration, a capacitively loaded panel is in electrical operative communication with orthogonal pairs of antenna panels. Each antenna panel defines an inner and outer surface and has an electromagnetic interference shielding material positioned thereon. The shielding material positioned may be positioned near a first or upper edge of each antenna panel of the assembly. It has been empirically determined that this configuration enables an operational bandwidth that is greater than 5:1 and a voltage standing wave ratio that is less than 3:1 over the 5:1 bandwidth.

BRIEF DESCRIPTION OF THE SEVERAL VIEWS OF THE DRAWINGS

Sample embodiments of the present disclosure are set forth in the following description, is shown in the drawings and is particularly and distinctly pointed out and set forth in the appended claims.

Similar numbers refer to similar parts throughout the drawings.

DETAILED DESCRIPTION

Figure 1:
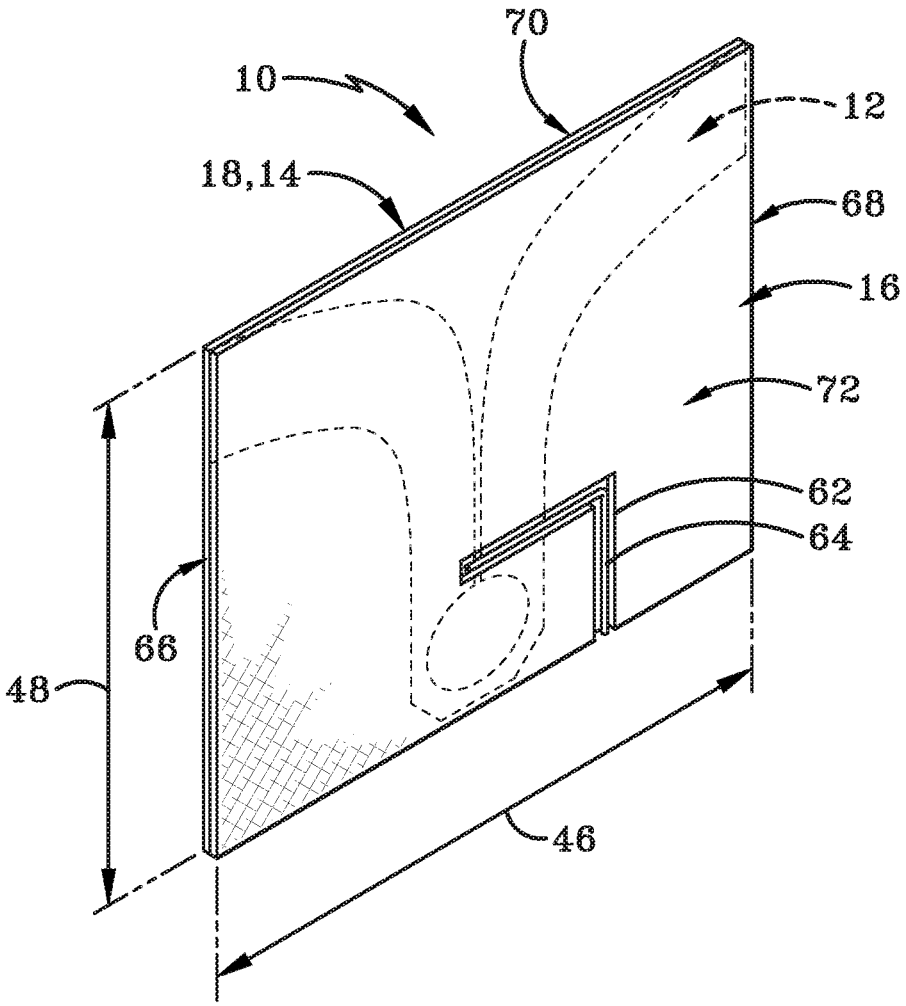
FIG. 1 (FIG. 1) is an isometric perspective view of an assembled antenna panel in accordance with the present disclosure.
Figure 2:
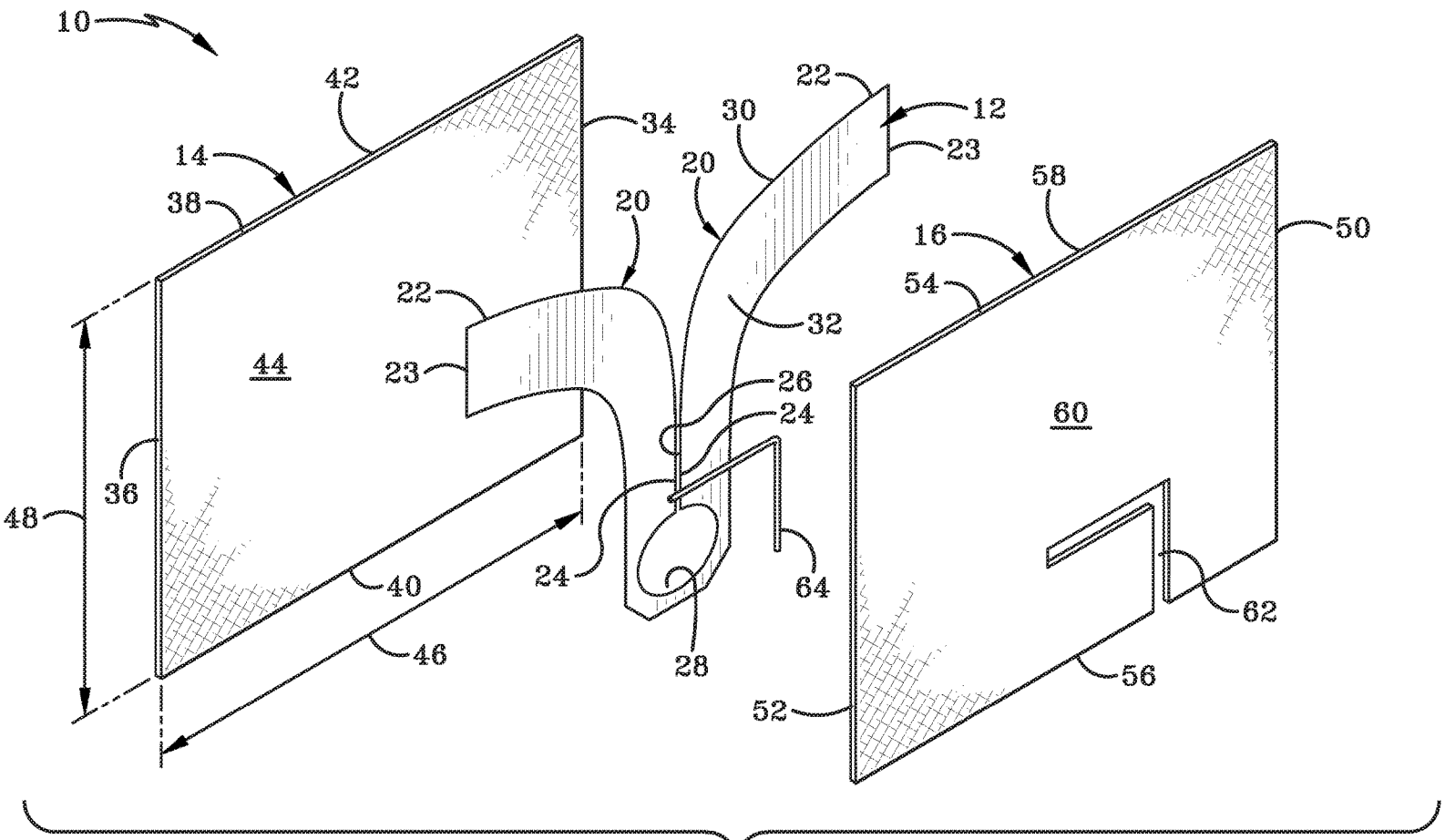
FIG. 2 (FIG. 2) is an exploded perspective view of the antenna panel shown in FIG. 1.

As depicted in FIG. 1 and FIG. 2, an exponentially tapered slot antenna is depicted generally at 10. The exponentially tapered slot antenna (ETSA) 10 includes a radiating element 12, a dielectric substrate 14, and a dielectric superstrate 16. The radiating element 12 is positioned between or "sandwiched between" the substrate 14 and the superstrate 16 so as to define a first antenna panel 18 when the components are assembled together.

Radiating element 12 includes an exponentially tapered edge 20 that extends from a wider first end 22 to a narrower second end 24. A slot 26 is formed near second end 24 of the exponentially tapered edge 20. A stub 28 is formed near the slot 26. The radiating element includes a first major surface 30 and an opposing second major surface 32. Inasmuch as the radiating element is a sheet of metallic or other electrically conductive material, the thickness of the radiating element 12 from the first surface 30 to the second surface 32 is very thin. Accordingly, a significant portion of the outer surface area of the radiating element 12 is defined by the major surfaces 30, 32. While stub 28 is shown as having a generally circular profile, it is to be understood that other shapes of the stub are entirely possible. For example, stub 28 may have a star pattern (i.e., fractal) or other geometric patterns may be implemented in the stub or another pattern with linear edges may form the stub.

Dielectric substrate 14 is a substantially rectangular or square shaped panel including a first end 34 offset parallel to a second end 36. An upper or first edge 38 may extend between first end 34 and second end 36. A lower or second edge 40 may extend offset parallel to the first edge 38 between first end 34 and second end 36. A first major surface 42 of substrate 14 is bound by the ends 34, 36 and the edges 38, 40. An opposing second major surface 44 is opposite the first major surface 42 and is also bound by the ends 34, 36 and the edges 38, 40. When assembled, the radiating element 12 substantially contacts substrate 14 such that the first surface 30 of radiating element 12 is in direct contact with the second major surface 44 of substrate 14.

A length 46 of substrate 14 is established as the longitudinal distance extending from the first end 34 to the second end 36. In one particular example, the length of substrate 14 is in a range from about 8 inches to about 14 inches. In another particular example, the length 46 of substrate 14 is in a range from about 10 inches to about 12 inches. In one particular example, the length 46 of substrate 14 is 11 inches. A height 48 associated with substrate 14 is determined by the dimension extending from the first edge 38 to the second edge 40. In one particular example, the height 48 of substrate 14 may be in a range from about 6 inches to about 12 inches. In another particular example, the height may be in a range from about 8 inches to about 10 inches. In another particular example, the height 48 of substrate 14 is 9 inches. In one example, the length 46 is 11 inches and the height 48 is 9 inches, and as such, other versions of ETSA 10 may provide wherein the length 46 of substrate 14 is greater than the height 48 of substrate 16. In another particular example, a ratio of the length 46 to height 48 of the substrate 14 may be about 1.2:1. In another example, a ratio of the height 46 to length 48 of the substrate 14 may be in a range from about 1.1:1 to about 1.5:1. In one non-limiting example, these ranges may be empirically determined to be critical so as to effectuate the achieved bandwidths and VSWR described in greater detail below.

Dielectric substrate 14 may be fabricated from a dielectric material as one having ordinary skill in the art would understand. The dielectric material utilized to fabricate substrate 14, in one example, may be an insulating material or a very poor conductor of electric current. Thus, when the material is placed in an electric field associated with ETSA 10, practically no current flows through dielectric substrate 14.

Superstrate 16 is formed from a dielectric material and may have similar dimensions as the substrate 14. Dielectric substrate 16 may be fabricated from a dielectric material one having ordinary skill in the art would understand. The dielectric material utilized to fabricate superstrate 16, in one example, may be an insulating material or a very poor conductor of electric current. Thus, when the material is placed in an electric field associated with ETSA 10, practically no current flows through dielectric superstrate 16. Further, in one example, the dielectric material utilized to fabricate superstrate 16 may be the same material utilized to fabricate substrate 14. However, it is entirely possible for two differing dielectric materials are use to respectively fabricate substrate 14 and superstrate 16. Additionally, superstrate 16 may have dimensions that differ from substrate 14.

Superstrate 16 may include a first end 50, an opposing second end 52, and a first edge 54 opposite and parallel to a second edge 56 wherein the first and second edges 54 extend parallel between first end 50 and second end 52. Substrate 16 is substantially planar including a first major surface 58 and an opposing second major surface 60. When the antenna panel 18 is assembled having the radiating element 12 sandwiched between substrate 14 and superstrate 16, the first major surface 58 of superstrate 16 substantially contacts the second major surface 32 of radiating element 12. In one embodiment, the second edge 56 may be interrupted by an inverted L-shaped slot 62 shaped complementary to an electrical cable or wire 64 which is in electrical communication with the radiating element 12 across the slot 26 as one having ordinary skill in the art would understand. The remaining edges and ends (50, 52, 53) of superstrate 16 are substantially continuous.

Figure 3:
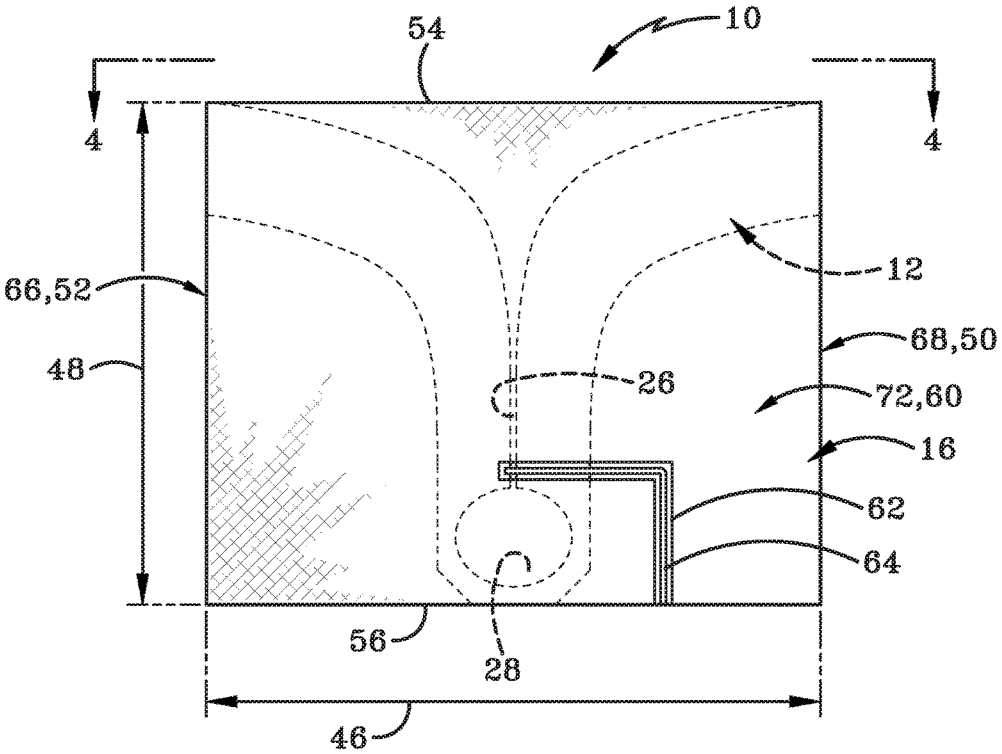
FIG. 3 (FIG. 3) is a front elevation view of the antenna panel.

As depicted in FIG. 3, when the substrate 14, the radiating element 12, and the superstrate 16 are assembled together, they collectively define the antenna panel 18. The antenna panel 18 has dimensions similar to that of substrate 14. Thus, the antenna panel 18 may have a length 46 and a height 48 determined by the dimensions identified above with respect to substrate 14. Additionally, when the antenna panel 18 is assembled, the first end 34 of substrate 14 substantially meets the first end 50 of superstrate 16 to define a first end 66 of the antenna panel 18. Additionally, when the antenna panel 18 is assembled, the second end 36 of substrate 14 substantially meets the second end 52 of superstrate 16 to collectively define a second end 68 of antenna panel 18. Second end 68 of antenna panel 18 is substantially parallel to the first end 66 of antenna panel 18. When the antenna panel 18 is assembled, the first surface 42 of substrate 14 establishes a collective first or inner surface 70 of the antenna panel 18. Similarly, the second surface 60 of superstrate 16 establishes a second surface or an outer surface 72 of antenna panel 18. The collective outer surface and inner surface as used with respect to first surface 70 and second surface 72 will be identified and explained later below inasmuch as the antenna panel 18 may be coupled with additional similar antenna panels in a box-like structure wherein the first (i.e., inner) surfaces 70 face each other to define the inner space of the general box-like configuration of the antenna. Similarly, the second surface 72 of the arranged antenna panels 18 would face outwardly from the general box-like structure. Thus, the terms inner and outer used with respect to antenna panel 18 when it is assembled box-like configuration as identified below.

Figure 4:
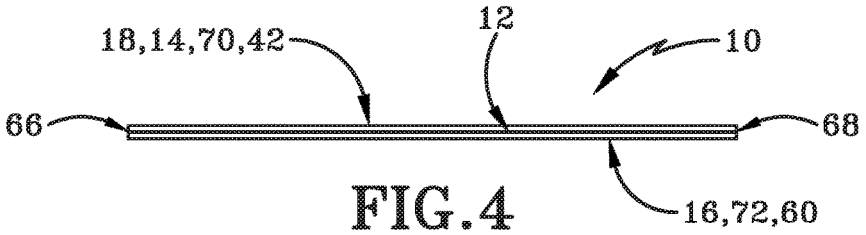
FIG. 4 (FIG. 4) is an end view of the antenna panel taken along line 4-4 in FIG. 3.

As depicted in FIG. 4, the thickness of the substrate 14 and the superstrate 16 is seen from a view along line 4-4 in FIG. 3. The thicknesses of the substrate 14 and the superstrate 16 are substantially equal. However, it is entirely possible for an embodiment of the present disclosure to provide varying thicknesses of the substrate 14 and the superstrate 16 if empirically determined designs are warranted.

Figure 5:
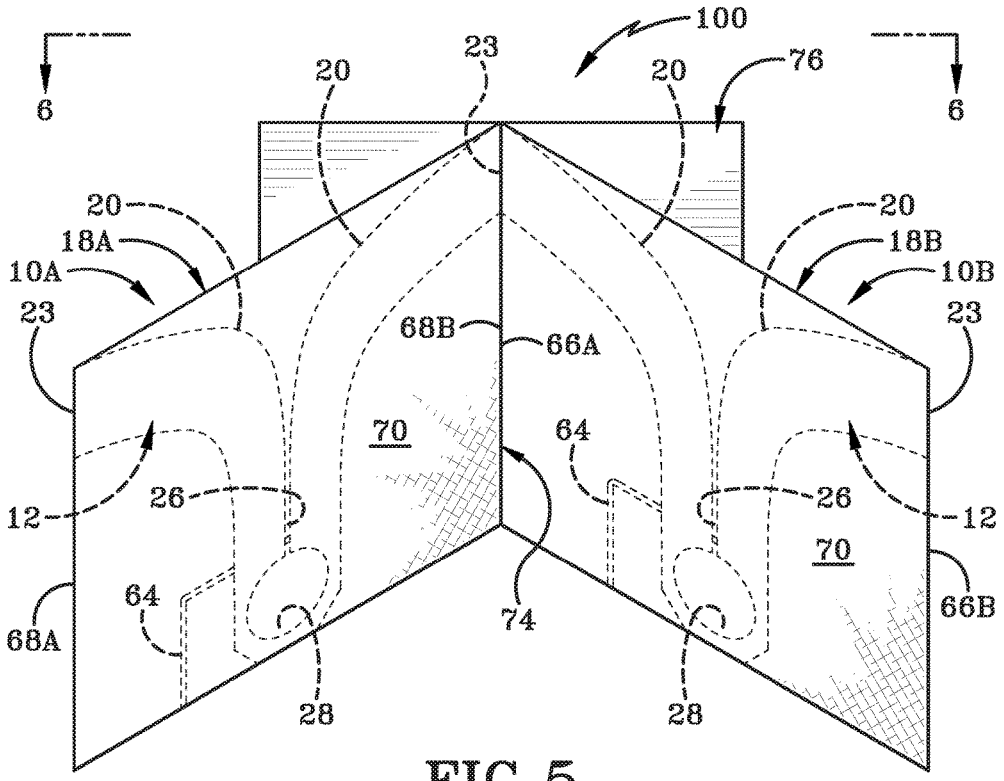
FIG. 5 (FIG. 5) is a perspective view of an antenna assembly formed from an orthogonal pair of antenna panels and further including a capacitive loaded panel.
Figure 6:
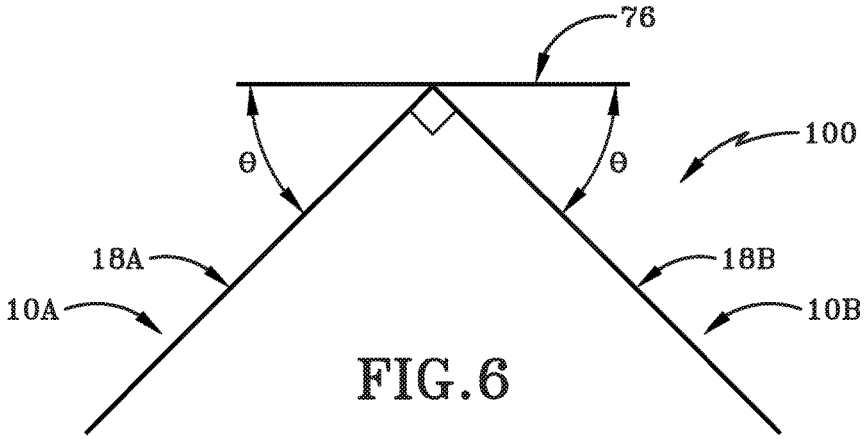
FIG. 6 (FIG. 6) is a top view of the antenna panel assembly taken along line 6-6 in FIG. 5.

FIG. 5 and FIG. 6 depict an antenna assembly in accordance with the present disclosure generally at 100. Antenna assembly 100 includes a first exponentially tapered slot antenna (ETSA) 10A, a second ETSA 10B, a corner union 74 formed by an orthogonal connection of first ETSA 10A and a second ETSA 10B, and a first capacitive loaded panel 76 connected to the first corner union 74 in operative electrical communication with the first ETSA 10A and the second ETSA 10B. First ETSA 10A includes an exponentially tapered edge 20 of a radiating element 12 positioned between a substrate 14 and superstrate 16 collectively defining a first antenna panel 18A. The first antenna panel 18A includes a first edge 66A and a second edge 68A. The second ETSA 10B includes an exponentially tapered edge of a radiating element positioned between a substrate and a superstrate collectively defining a second antenna panel 18B including a first edge 66B and a second edge 68B.

With continued reference to FIG. 5 and FIG. 6, the orthogonal relationship between the first ETSA 10A and the second ETSA 10B establishes a 90° angle therebetween. On an opposite side of the 90° angle, the capacitive loaded panel 76 intersects the union 74 so as to establish a first angle and a second angle relative to first antenna panel 18A and second antenna panel 18B, respectively. In one particular embodiment, a 45° angle is established relative to each of the first antenna panel 18A and the second antenna panel 18B. However, it is entirely possible for the angle (θ) established between the respective panels 18A, 18B relative to the capacitive loaded panel 76 be different. In one scenario, the angle (θ) relative to the first antenna panel 18A is greater than the angle (θ) relative to the second antenna panel 18B. In one exemplary embodiment, the capacitive loaded panel 76 is in electrical communication with the radiating element 12 within each ETSA, 10A, 10B. In one example, panel 76 is formed from copper. In another example, panel 76 consists essentially of a copper alloy. However, other conductive materials that effectuate a capacitive load on the antenna assembly 100 are possible.

FIG. 5 and FIG. 6 further depict that the two adjacent pairs of antenna panels 18A, 18B form an orthogonal pair. When this orthogonal pair is fed with a ±90° phase difference, the first antenna panel 18A and the second antenna panel 18B form either a right-hand or left-hand polarization.

FIG. 5 and FIG. 6 further depict a direct electrical connection of the upper edges 23 of each respective conducting element 12. Stated otherwise, the upper edge 23 on the radiating element of panel 18A directly contacts the upper edge 23 on the radiating element of panel 18B. This connection of the edges 23 forms a right angle. Electrical current is able to move from one radiating element to the other radiating element via the connection of edges 23. Furthermore, the capacitive load panel 76 is also directly connected to the edges 23 of respective radiating elements 12. Thus, a three way electrical connection exists at the union 74 of the two panels 18A, 18B.

Figure 7:
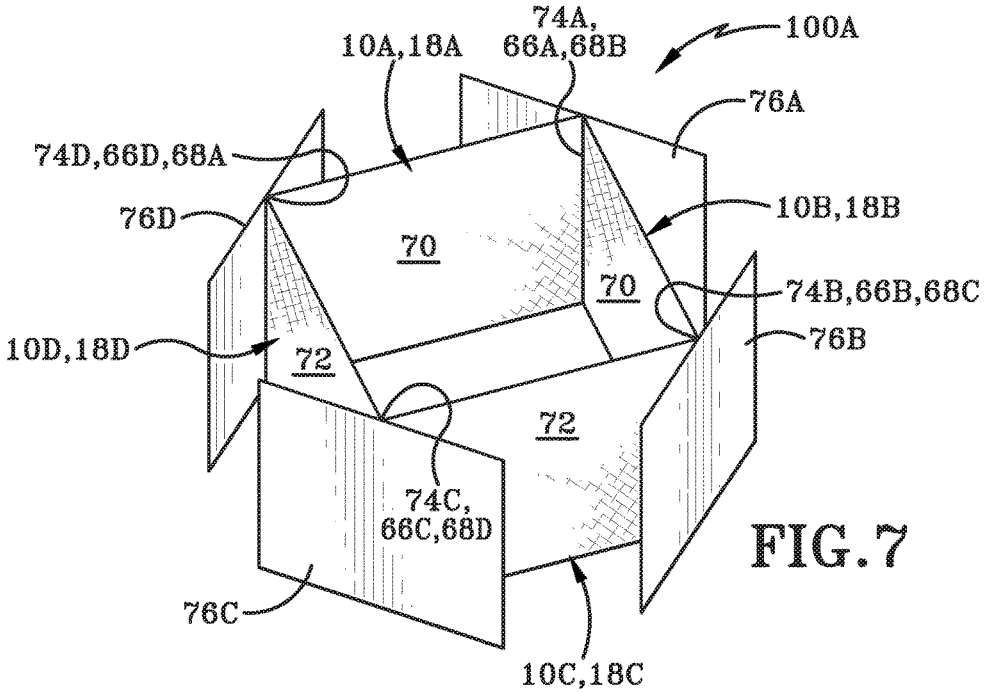
FIG. 7 (FIG. 7) is a perspective view of an antenna assembly in accordance with one aspect of the present disclosure.

FIG. 7 depicts an antenna assembly in accordance with the present disclosure generally at 100A. The antenna assembly 100A is similar to antenna assembly 100 having the orthogonally connected first antenna panel 18A and second antenna panel 18B, and further includes an orthogonally connected third antenna panel 18C and a fourth antenna panel 18D. The four antenna panels 18A, 18B, 18C, and 18D are connected together to form a general box-like structure. Between adjacent orthogonal panels, a corner union is respectively formed by the orthogonal connection of the first edge of one corner panel to a second edge of another corner panel. For example, a third ETSA 10C includes an exponentially tapered edge on a radiating element 12 positioned between a substrate and a superstrate collectively defining the third antenna panel 18C including a first edge 66C and a second edge 68C. The third antenna panel 18C is offset parallel to the first antenna panel 18A. A second corner union 74B is formed by the orthogonal connection of the first edge 66B on the second antenna panel 18B to the second edge 68C on the third antenna panel 18C. Additionally, a second capacitive loaded panel 76B is connected to the second corner union 74B and is in operative electrical communication with the second ETSA 10B and the third ETSA 10C. In one example, the second capacitive loaded panel 76B is in direct electrical communication via a three-way connection between the panel 76B, the edge 23 on radiating element 12 of second ESTA 10B, and the edge 23 on radiating element 12 of third ESTA 100.

Antenna assembly 100A may further include a fourth ETSA 10D including an exponentially tapered edge on a radiating element positioned between a substrate and a superstrate collectively defining a fourth antenna panel 18D including a first edge 66D and a second edge 68D. The fourth antenna panel 18D is offset parallel relative to the second antenna panel 18B. A third corner union 74C is formed by the orthogonal connection of the first edge 66C on the third antenna panel 18C to the second edge 68D on the fourth antenna panel 18D. A third capacitive loaded panel 76C is connected with the third corner union 74C in operative electrical communication with the third ETSA 10C and the fourth ETSA 10D. In one example, the third capacitive loaded panel 76C is in direct electrical communication via a three-way connection between the panel 76C, the edge 23 on radiating element 12 of third ESTA 10C, and the edge 23 on radiating element 12 of fourth ESTA 10D.

A fourth corner union 74D is formed by the orthogonal connection of the second edge 68A on the first antenna panel 18A to the first edge 66D on the fourth antenna panel 18D. A fourth capacitive loaded panel 76D is connected to the fourth corner union 74D in operative communication with the first ETSA 10A and the fourth ETSA 10D. In one example, the fourth capacitive load panel 76D is in direct electrical communication via a three-way connection between the panel 76C, the edge 23 on radiating element 12 of fourth ESTA 10D, and the edge 23 on radiating element 12 of first ESTA 10A.

With continued reference to FIG. 7, it is depicted that the orthogonal alignments of the first antenna panel 18A, second antenna panel 18B, third antenna panel 18C, and fourth antenna panel 18D define an open box-like antenna structure including a collective outer surface and a collective inner surface. The outer surface is identified as 72 and the inner surface is identified as 70.

Figure 7A:
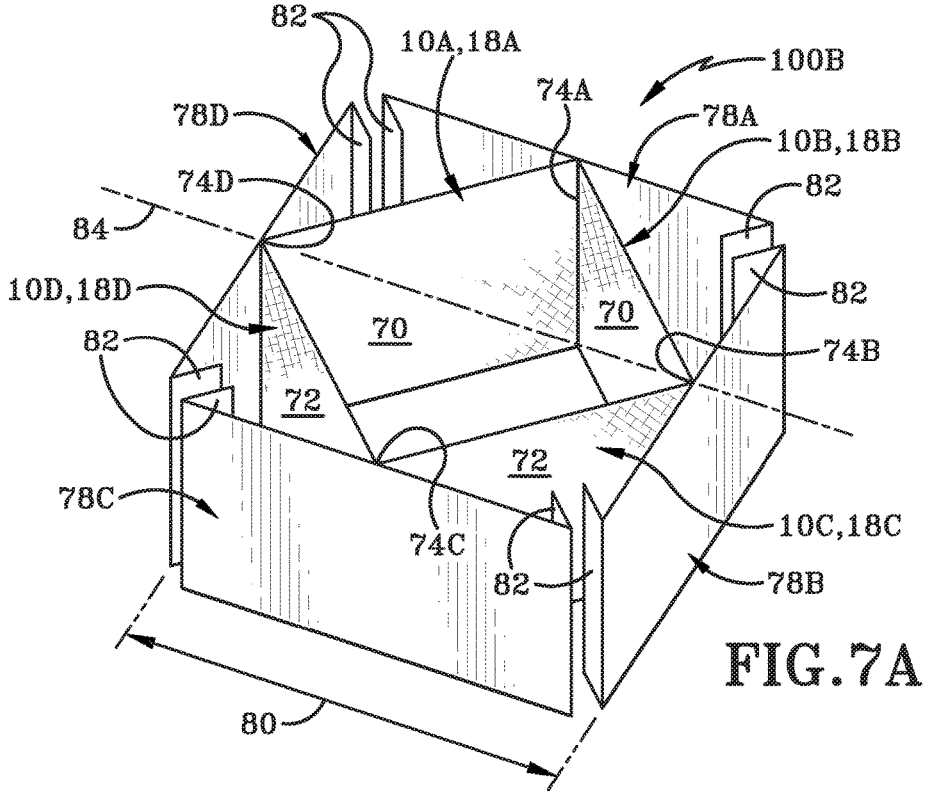
FIG. 7A (FIG. 7A) is a perspective view of an antenna assembly with an alternative aspect of the present disclosure.

FIG. 7A depicts an alternative embodiment of an antenna assembly showing generally at 100B. Antenna assembly 100B includes similar antenna panels 18A, 18B, 18C, and 18D as assembly 100A. Antenna assembly 100B differs in that the capacitively loaded panels are shaped differently. More particularly, antenna assembly 100B includes capacitive loaded panel 78A which is connected with or positioned adjacent first union 74A so as to be an operative electrical communication with the first ETSA 10A and the second ETSA 10B. A second capacitive loaded panel 78B is connected to or positioned adjacent the second corner union 74B in operative electrical communication with the second ETSA 10B and the third ETSA 100. A third capacitive loaded panel 78C is connected with or positioned adjacent the corner union formed by the orthogonal connection of the first edge of the third antenna panel with the second edge of the fourth antenna panel. The third capacitive loaded panel 78C is an operative electrical communication with the third ETSA 100 and the fourth ETSA 10D. A fourth capacitive loaded panel 78D is connected to or positioned adjacent the fourth corner union 74D in operative electrical communication with the fourth ETSA 10D and the first ETSA 10A.

The capacitive panels 78A, 78B, 78C, and 78D of FIG. 7A have a longer length than those identified in FIG. 7. A dimensional length 80 of each capacitive panel 78A, 78B, 78C, and 78D in FIG. 7A is equal to an imaginary hypotenuse length extending from union 74B to fourth union 74D. The hypotenuse established between union 74B and 74D lies along plane 84 as indicated in FIG. 7A. Stated otherwise, when the length of each panel 18A, 18B, 18C, and 18D is equal such that the arranged panels form an open box-like structure having equal lengths (i.e. a square box), the dimensional length 80 of the outer capacitive loaded panels 78A, 78B, 78C, and 78D is equal to the square root of two times the length of one of the antenna panels 18. Stated otherwise, if the length of one antenna panel is X, then the length of the capacitive loaded panels 78 is $x*\sqrt{2}$. First capacitive loaded panel 78A and third capacitive loaded panel 78C are offset parallel relative to each other and parallel to plane 84. Second capacitive loaded panel 78B and fourth capacitive loaded panel 78D intersect plane 84 in a generally perpendicular manner. The height of the capacitive loaded panels 78A, 78B, 78C, and 78D is equal to that of the height of each antenna panel 18. Additionally, each capacitive panel may have inwardly extending flanges 82 which extend in a cantilevered manner from a rigid connection with the outermost edges of the capacitive loaded panel extend towards the antenna panel 18 and terminate short thereof such that a space or a gap is defined between the inner terminal edge of flange 82 and the outer surface 72 of the antenna panels 18.

As depicted in FIG. 8A, FIG. 8B, FIG. 8C, FIG. 9, and FIG. 10, one or more of the antenna panels 18 may have an electromagnetic interference (EMI) shielding material positioned along at least a portion of either the first surface or the second surface, or along both first and second surfaces of the antenna panel 18. One exemplary EMI shielding material is commercially available for sale by ARC Technologies, Inc. of Amesbury, Mass., under the brand name WAVE-X. The thickness of the EMI shielding material may be in a range from about 0.005 inches to about 0.04 inches.

Figure 8A:
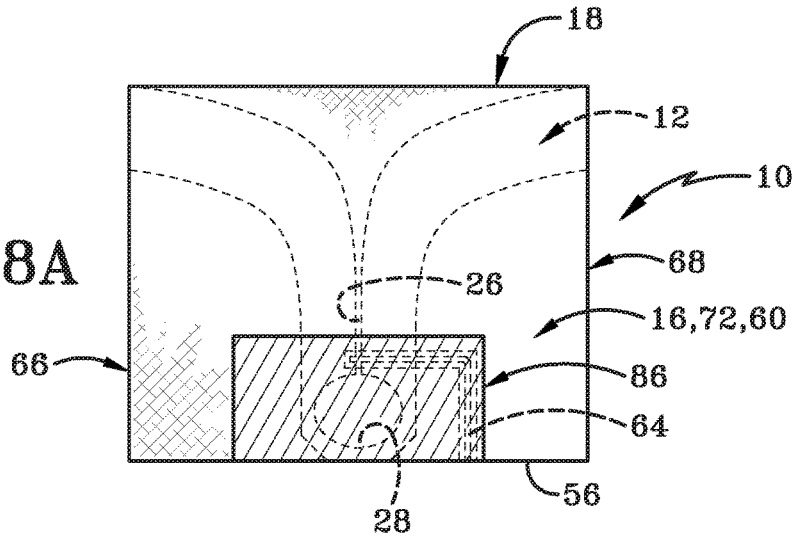
FIG. 8A (FIG. 8A) is a front elevation view of one antenna panel having an electromagnetic interference shielding material positioned near a bottom or second edge thereof.

FIG. 8A depicts the EMI shielding material 86 as positioned along a portion of second surface 72 of antenna panel 18 of ETSA 10. EMI shielding material 86 is positioned near the bottom edge 56 of superstrate 16. In this position, the EMI shielding material 86 covers the stub 28. Additionally, the EMI shielding material may cover cable 64. EMI shielding material 86 may further cover a portion of slot 26 and the narrower second end 24 of the exponentially tapered edge 20.

Figure 8B:
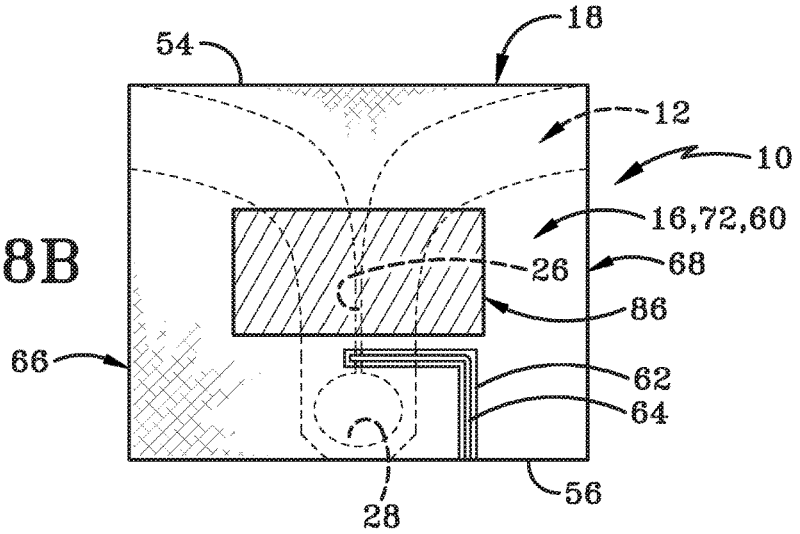
FIG. 8B (FIG. 8B) is a front elevation view of an antenna panel having the electromagnetic interference shielding material positioned intermediate a top edge and a bottom edge thereof.

FIG. 8B depicts an alternative arrangement of EMI shielding material 86 that is positioned approximately half way between the first edge 54 of superstrate 16 and the lower second edge 56 of superstrate 16. When the EMI shielding material 86 is in the approximate middle position, the shielding material 86 covers the region of the exponentially tapered edge 20 on the radiating element 12 intermediate the wider first end 22 and the narrower second end 24.

Figure 8C:
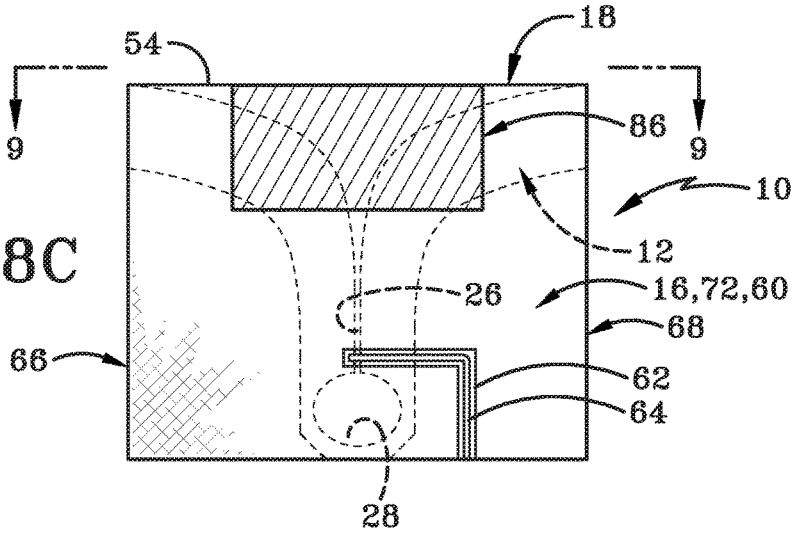
FIG. 8C (FIG. 8C) is a front elevation view of the antenna panel having the electromagnetic interference shielding material positioned near the top edge thereof.

FIG. 8C depicts another embodiment of the present disclosure where the strip of EMI shielding material 86 is positioned near the first edge 54 of superstrate 16 of antenna panel 18 of ETSA 10. Inasmuch as EMI shielding material 86 is a strip of material having a generally rectangular profile when viewed from above, a longitudinal edge of the strip material 86 the EMI shielding material 86 formed in a strip substantially collinear with edge 54. EMI shielding material 86 in the upper position as indicated in FIG. 8C substantially covers the throat defined by the exponentially tapering edge 20 on radiating element 12. When the EMI shielding material 86 is in its uppermost position, as indicated in FIG. 8C, material 86 substantially covers the wider first end 22 of edge 20, and is positioned above the narrower second end 24 of edge 20. Furthermore, EMI shielding material 86 may be positioned offset from cable 64 and offset from stub 28. In one example, the EMI shielding material is offset about one inch from edge 54 (i.e., offset below edge 54 by one inch such that a narrow strip of the outer surface of the panel is exposed above the EMI shielding material).

Figure 9:
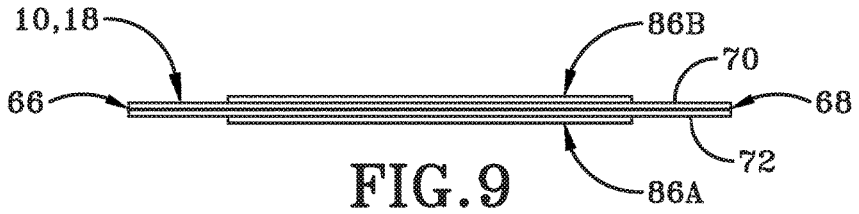
FIG. 9 (FIG. 9) is an end view taken along line 9-9 in FIG. 8C depicting the electromagnetic interference shielding material positioned on both sides of the antenna panel.

FIG. 9 depicts an example in accordance with the present disclosure wherein the antenna panel 18 includes EMI shielding material located on both sides thereof. More particularly, a first EMI shielding material 86A is positioned along outer surface 72 of antenna panel 18. A second EMI shielding material 86B is positioned along inner surface 70. In each instance, the length of the strips of the shielding material 86A, 86B is equal and terminates short of the first end 66 and the second end 68. However, it is entirely possible for the lengths of the first and second EMI shielding materials 86A, 86B to be different. Furthermore, it is entirely possible for the length of EMI shielding material 86A and 86B to extend along the entire length of panel 18A between first end 66 to second end 68.

Figure 10:
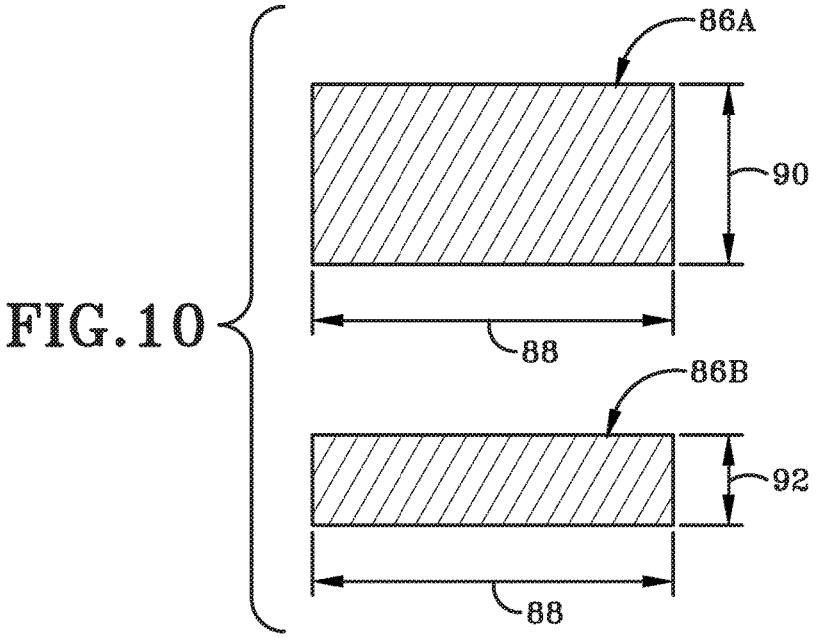
FIG. 10 (FIG. 10) is a schematic representation of a first electromagnetic interference shielding material and second electromagnetic interference shielding material, wherein the two electromagnetic shielding materials have similar lengths but differing heights.

FIG. 10 represents the dimensions of shielding material 86A and shielding material 86B. The lengths of shielding material 86A and 86B are equal and represented by dimensional length 88. The first EMI shielding material 86A is positioned along the outer surface 72 antenna panel 18 has a height 90. In one example, the height of first EMI shielding material 86A may be equal to the height of second EMI shielding material 86B positioned along the first inner surface of panel 18. However, in another particular example, and as specifically indicated in FIG. 10, the height of second end EMI shielding material 86B represented by dimensional height 92 is less than that of height 90 of first EMI shielding material 86A. In one particular embodiment, the length 88 of both the first EMI shielding material 86A and the second EMI shielding material 86B is six inches. The dimensional height 90 of first EMI shielding material 86A positioned along the outer surface 72 of antenna panel 18 may be about three inches. The height 92 of the second EMI shielding material 86B positioned along the inner surface 70 of antenna panel 18A may be 1.5 inches. Stated otherwise, and in accordance with the present disclosure, the height of the first EMI shielding material on the outer surface of the antenna panel is greater than height of the second EMI shielding material located on the inner surface of the antenna panel. In another particular embodiment, the height of the first EMI shielding material 86A is at least twice that of the height 92 of the second EMI shielding material 86B. In another particular embodiment, height 90 of the first EMI shielding material 86A is about at least 1.5 inches greater than the height 92 of the second EMI shielding material 86B.

In one example, the thickness of second EMI shielding material 86B is thicker than the thickness of first EMI shielding material 86A. In one example, the thickness associated with the second EMI shielding material is 40 mil. The thickness associated with the first EMI shielding material 86A is 20 mil. Stated otherwise, the thickness of the second EMI shielding material may be greater than the thickness of the first EMI shielding material 86A. Further stated otherwise, the thickness of the second EMI shielding material 86B located along the inner surface 70 of antenna panel 18 may be approximately twice as thick than the thickness of the first EMI shielding material 86A located along the outer surface 72 of first panel 18.

Figure 11:
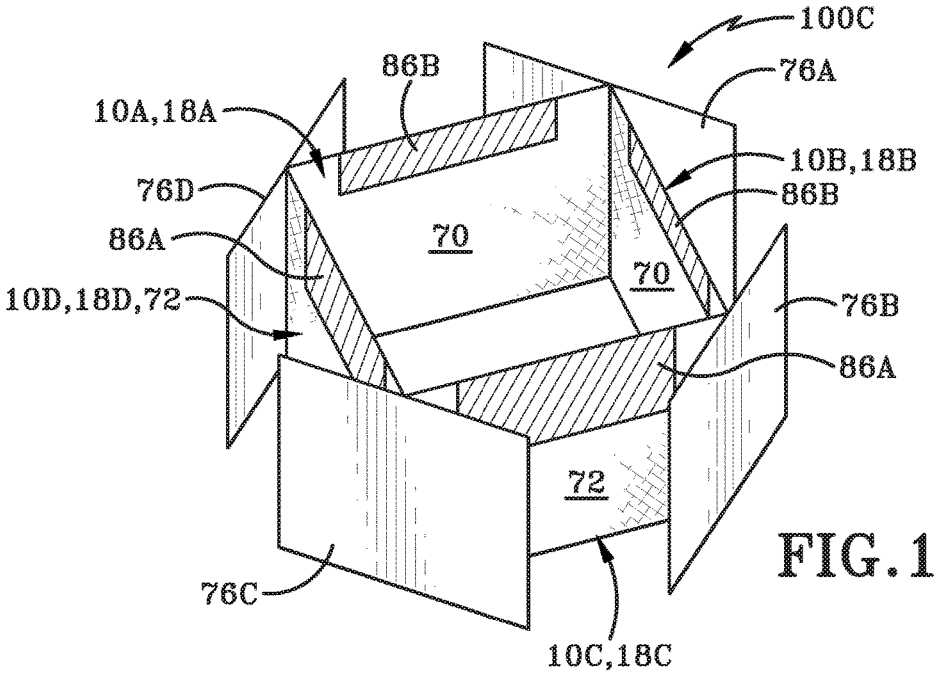
FIG. 11 (FIG. 11) is a perspective view of an antenna assembly in accordance with the present disclosure having a box-like configuration with four rectangular antenna panels and four square capacitive loaded panels with electromagnetic interference shielding material positioned on both sides of the antenna panels.

FIG. 11 depicts an antenna assembly in accordance with the present disclosure shown generally at 100C. Antenna assembly 100C includes four antenna panels 18A, 18B, 18C, and 18D connected together to form a box-like structure with capacitive loaded panels 76A, 76B, 76C, and 76D located proximate, adjacent, near, or along the outer unions at approximately 45° angles. Each one of the panels 18A-18D includes a first EMI shielding material 86A positioned on its outer surface (the collective outer surface 72) and has a height 90 that is greater than a height 92 of a second EMI material 86B positioned along the inner surface of each antenna panel (the collective inner surface 70). In the embodiment shown in FIG. 11, the EMI shielding materials 86A, 86B are positioned near first edges 54 (the upper ends of each panel) to cover the wider first end of the exponentially tapered edge 20 of the radiating element 12 (near the throat of radiating element 12) lying beneath the superstrate 16 and the substrate 14, respectively.

Figure 12:
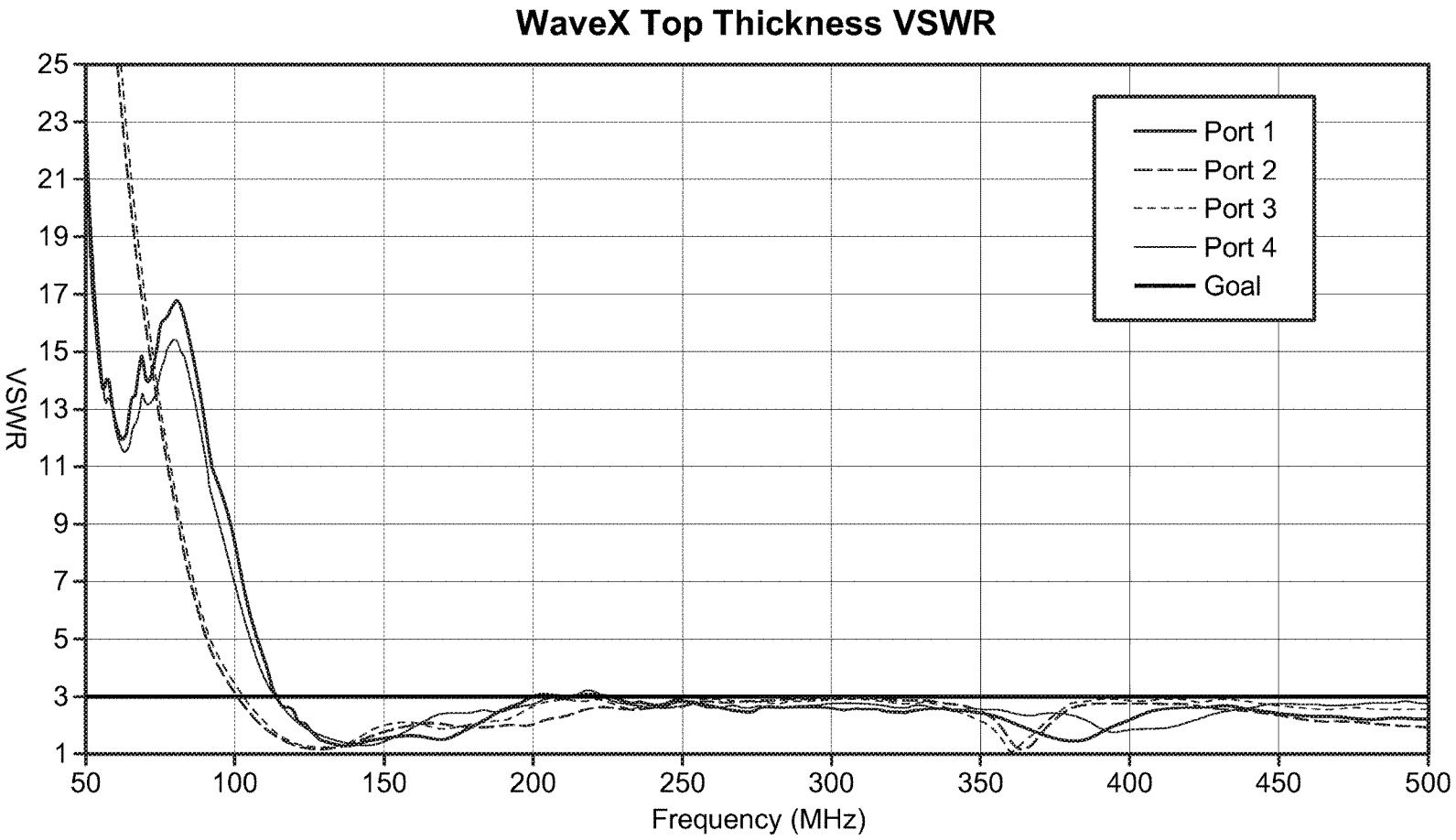
FIG. 12 (FIG. 12) is a graph depicting the voltage standing wave ratio versus frequency of the antenna assembly depicted in FIG. 11.

FIG. 12 depicts a graph of the voltage standing wave ratio (VSWR) versus a frequency. The graph depicts the empirical results from the antenna assembly 100C. The antenna assembly 100C was optimized to achieve the goal of having a VSWR less than three for frequencies greater than about 125 MHz. In obtaining the graphical results depicted in FIG. 12, each of the radiating elements 12 on the antenna panels 18A, 18B, 18C, and 18D were connected with a four-port network analyzer. The four ports are identified by distinct dashed lines in the graph of FIG. 12. Power was applied to one port at a time and the response was captured and is shown in the graph. As can be seen, each of the ports has a VSWR less than three for frequencies greater than about 125 MHz. It has been empirically determined that the EMI shielding material located near the top of each respective antenna panel 18 helps achieve the target goal of a VSWR less than three (see "GOAL" line identified in FIG. 12). In this particular antenna assembly 100C, the thickness of the EMI shielding material located along the inner surface of antenna panel 18 is about 40 mil. The thickness of the EMI shielding material located on the outer surface of antenna panel 18 is about 20 mil. The results of FIG. 12 depict that the first and second EMI shielding materials were center about a vertical center line of each respective panel and were positioned one inch from the top edge or first edge of the panel 18. However, it is believed that similar results could be achieved by positioning the first and second EMI shielding materials collinear with the first edge of each respective panel 18.

Figure 13:
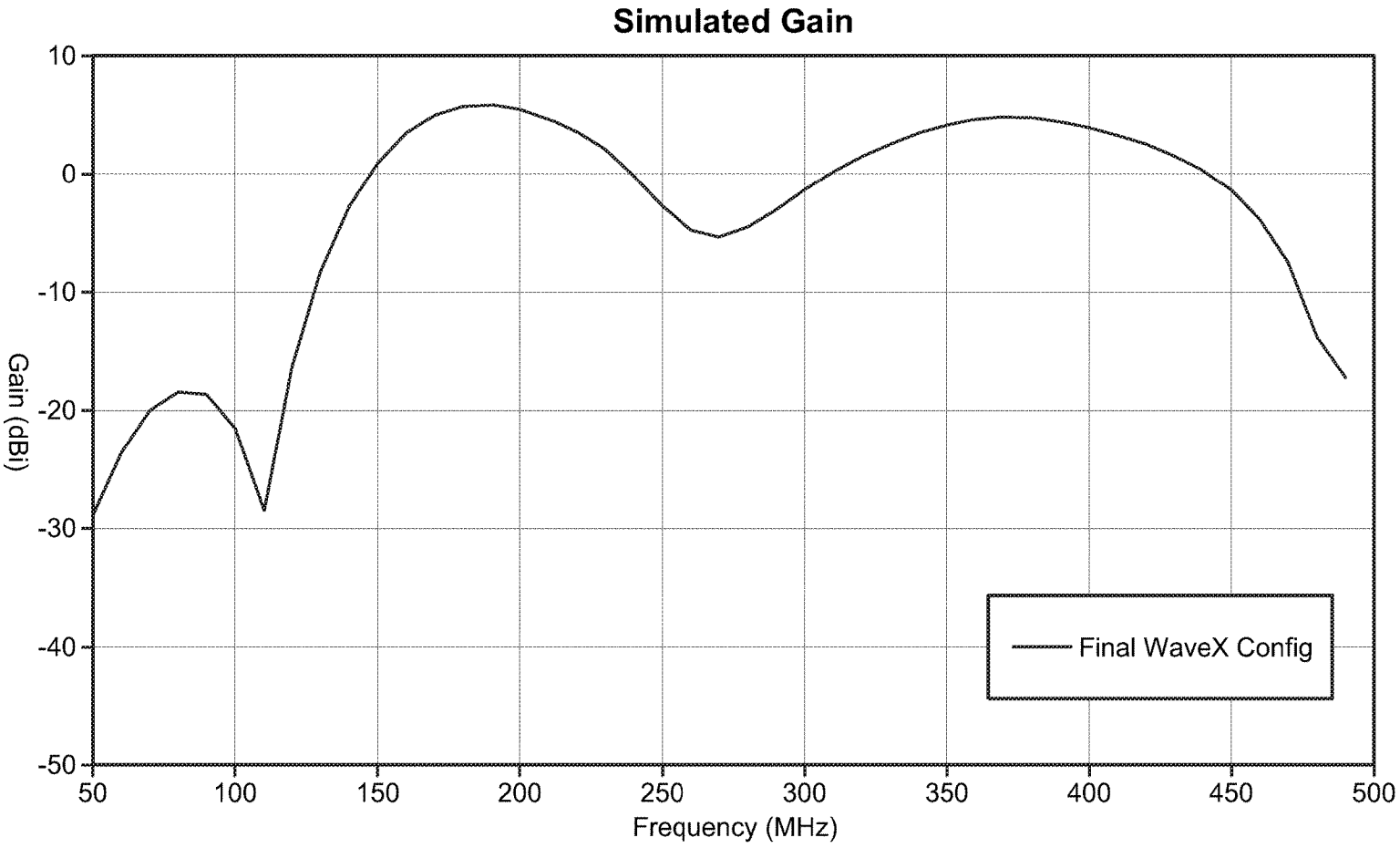
FIG. 13 (FIG. 13) is a graph of the simulated realized gain versus frequency for the antenna assembly depicted in FIG. 7A.

FIG. 13 depicts a graph of realized gain using the antenna assembly 100B. The gain requirement (dBi) is at least −7 dBi for frequencies between 125 MHz and 475 MHz. Antenna assembly 100B should be able to achieve a gain greater than at least −7 dBi for all frequencies between about 125 MHz and about 475 MHz. It is believed that the construction of the antenna assembly 100B further coupled with the first and second EMI shielding materials located on the respective inner and outer surfaces of panels 18 assists and accomplishes the gain requirements across all of the frequencies greater than 125 MHz and less than about 475 MHz. It is further believed that the capacitive loaded panels 78A-78D further contribute to the realization of gain greater than at least −7 dBi for the frequencies greater than about 125 MHz.

Figure 14:
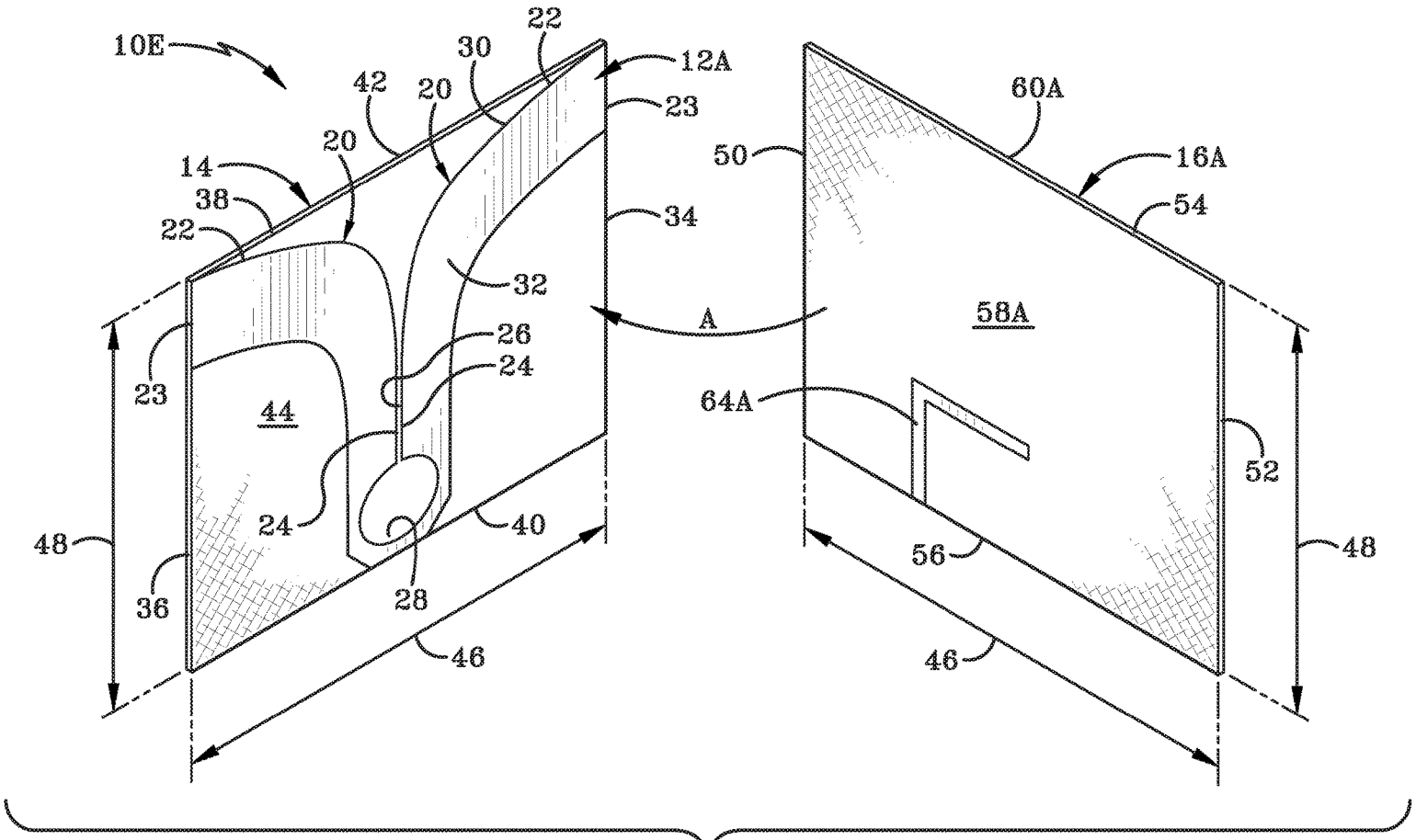
FIG. 14 (FIG. 14) is a partially exploded perspective view of an alternative embodiment of an exponentially tapered slot antenna.

As depicted in FIG. 14, an alternative embodiment of an ETSA is depicted generally at 10E. ETSA 10E includes a substrate 14 and a superstrate 16A. Substrate 14 and superstrate 16A are assembled together in the direction of Arrow A to sandwich the radiating element 12A therebetween. Superstrate 16A is a substantially planar member having the lower edge 56 spaced apart from the upper edge 54. In superstrate 16A, the lower edge 56 is continuous between the first end 50 and the second end 52. Thus, no slot is defined through the panel 16A from its first surface 58A to its second surface 60A. The first major surface 58A is substantially continuous and planar. An opposite second surface 60A is also substantially continuous and planar. A conductive element 64A may have the shape of an inverted L and may be directly attached to the first major surface 58A of superstrate 16A. Conductive element 64A, when assembled, crosses the slot 26 on radiating element 12A and is connected thereto by a conductive vias. Furthermore, conductive element 64A may have an alternative configuration (i.e., not L-shaped) so long as a portion of element 64A crosses over the slot 26 on radiating element 12A. Additionally, conductive element 64A may be copper, however other conductive materials are entirely possible.

In accordance with one aspect of the present disclosure, the antenna assembly constructed from multiple ETSAs (such as 10A, 10B, 10C, 10D or 10E) may be oriented in different directions so as to transmit/receive signals from the same. Additionally, with respect to the surface orientation of the ETSAs, they may be flipped around from what is shown herein, so long as every antenna panel of every ETSA faces the same direction. For example, in all of the previous embodiments, the first major surface of the substrate formed the collective inner surface 70 and the second major surface of the superstrate formed the collective outer surface 72 of the box-like design. These antenna panels could be rearranged such that the first major surface of the substrate forms the collective outer surface 72 and the second major surface of the superstrate forms the collective inner surface 70 of the box-like design. It is believed to be more important that all respective panels forming the box-like design are oriented in a similar manner (i.e., all the first major surfaces of the respective substrates is inward or all the first major surfaces of the respective substrates is outward).

In one example, the term "capacitive load" or "capacitive loaded" or "capacitively loaded" with respect to panels 76A-76D and 78A-78D refers to a conductive panel that is not necessarily connected to an external power source, but rather the inherent property of the conductive panel creates has a capacitance when connected between two orthogonal radiating elements. They may also refer to a capacitive load that has a current waveform which is leading the voltage waveform, therefore the voltage peaks and current peaks are not in phase. The amount of phase delay is given by the cosine of the angle between the vectors representing voltage and current. In other examples, the capacitively loaded panels may also have reactive power.

In operation, the capacitive load panels (76 or 78) on the antenna assemblies presented herein (100A or 100B) push the radiating element 12 low in frequency. Thus, in an antenna without the capacitive load panels, the antenna would not work as low in frequency antenna because the radiating elements are not electrically long enough to work to 100 MHz. Thus, the capacitive load panels (76 or 78) on the antenna assemblies presented herein (100A or 100B) enables the radiating elements 12 go low in frequency (i.e., at least 100 MHz). Additionally, when represented schematically, some antenna assemblies generally look somewhat inductive, thus, by adding capacitive panel 76 or 78 and so by adding some capacitance, the antennas moves more towards the center of a Smith Chart for a stronger match.

In accordance with another aspect of the present disclosure, the EMI shielding material is able to make antennas look and behave as if they are electrically longer in frequency than the original construction. The EMI shielding material makes the low frequency antennas look electrically longer because it increases the magnetic permittivity ($\varepsilon_r$) and permeability ($\mu_r$). Typically, most dielectric materials (such as the ones forming the substrate and the superstrate) do not have a high permittivity. The EMI shielding material has a very high permittivity. Thus, with a high permittivity the antenna looks and behaves as electrically longer without shrinking the bandwidth In accordance with another aspect of the present disclosure, the antenna assembly 100A, 100B may include a combination of both the capacitive load panels 76 or 78 and the EMI shielding material to make the antenna assembly 100A, 100B look electrically longer making it work lower at lower frequencies. One exemplary advantage enables the antenna assembly 100A, 100B to look electrically longer so it works on lower frequency because there may be space constraints in which the antenna needs to operate. One exemplary space constraint is the depth of the antenna (Z-axis or height of antenna, which was about 9 inches). The combination of both the capacitive load panels 76 or 78 and the EMI shielding material to make the antenna assembly 100A, 100B work lower in frequency without making the antenna panels 18 larger relative the depth of the box-like antenna design.

Also, various inventive concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one." The phrase "and/or," as used herein in the specification and in the claims (if at all), should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc. As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures.

An embodiment is an implementation or example of the present disclosure. Reference in the specification to "an embodiment," "one embodiment," "some embodiments," "one particular embodiment," or "other embodiments," or the like, means that a particular feature, structure, or characteristic described in connection with the embodiments is included in at least some embodiments, but not necessarily all embodiments, of the invention. The various appearances "an embodiment," "one embodiment," "some embodiments," "one particular embodiment," or "other embodiments," or the like, are not necessarily all referring to the same embodiments.

If this specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the preferred embodiment of the disclosure are an example and the disclosure is not limited to the exact details shown or described.

The invention claimed is:

1. An antenna assembly comprising:

a first exponentially tapered slot antenna (ETSA) including an exponentially tapered edge on a radiating element positioned between a substrate and a superstrate collectively defining a first antenna panel including a first end and a second end;

a second ETSA including an exponentially tapered edge of a radiating element positioned between a substrate and a superstrate collectively defining a second antenna panel including a first end and a second end;

a first corner formed by an orthogonal alignment of the first end of the first antenna panel with the second end of the second antenna panel;

a first capacitive loaded panel adjacent the first corner in operative electrical communication with the first ETSA and the second ETSA;

a third ETSA including an exponentially tapered edge on a radiating element positioned between a substrate and a superstrate collectively defining a third antenna panel including a first end and the second end;

the third antenna panel offset parallel to the first antenna panel;

a second corner formed by an orthogonal alignment of the first end of the second antenna panel with the second end of the third antenna panel; and a second capacitive loaded panel adjacent the second corner in operative electrical communication with the second ETSA and the third ETSA.

2. The antenna assembly of claim 1, further comprising:

a first angle formed between the first capacitive loaded panel and the first antenna panel;

a second angle formed between the first capacitive loaded panel and the second antenna panel; and wherein the first angle and the second angle are both 45°.

3. The antenna assembly of claim 1, further comprising:

a first electromagnetic interference (EMI) shielding material positioned along a first major surface of the first antenna panel.

4. The antenna assembly of claim 3, further comprising:

a second EMI shielding material positioned along an opposite second major surface of the first antenna panel.

5. The antenna assembly of claim 4, wherein the first and second EMI shielding material are positioned over a wider first end of the exponentially tapered edge.

6. The antenna assembly of claim 1, further comprising:

a fourth ETSA including an exponentially tapered edge on a radiating element positioned between a substrate and a superstrate collectively defining a fourth antenna panel including a first end and the second end;

the fourth antenna panel offset parallel to the second antenna panel;

a third corner formed by an orthogonal alignment of the first end of the third antenna panel with the second end of the fourth antenna panel;

a third capacitive loaded panel adjacent the third corner in operative electrical communication with the third ETSA and the fourth ETSA;

a fourth corner formed by an orthogonal alignment of the second end of the first antenna panel with the first end of the fourth antenna panel; and a fourth capacitive loaded panel adjacent the fourth corner in operative electrical communication with the first ETSA and the fourth ETSA.

7. The antenna assembly of claim 6, further comprising:

wherein the orthogonal alignments of the first, second, third, and fourth antenna panels define an open box-like antenna structure including a collective outer surface and a collective inner surface; and a first electromagnetic interference (EMI) shielding material positioned along at least a portion of the collective outer surface.

8. The antenna assembly of claim 7, further comprising:

a second EMI shielding material positioned along at least a portion of the collective inner surface.

9. The antenna assembly of claim 8, further comprising:

an operational bandwidth of the open box-like antenna structure that is at least 5 to 1 (5:1); and a Voltage Standing Wave Ratio (VSWR) of the open box-like antenna structure that is less than 3:1 over the at least 5:1 bandwidth.

10. The antenna assembly of claim 8, wherein an instantaneous bandwidth is equal to the operational bandwidth.

11. The antenna assembly of claim 8, wherein the open box-like antenna structure has dimensions in the following ranges: a length less than about 20 inches, a width less than about 20 inches, and a height less than about 15 inches; and wherein each of the four capacitive loaded panels is square shaped with dimensions in a range from about 6"×6" to about 12"×12".

12. The antenna assembly of claim 8, wherein the first antenna panel and the second antenna panel form an orthogonal pair and when the first and second antenna panels are fed with a ±90° phase difference, the first ETSA and the second ETSA respectively form either right hand or left hand circular polarization.

* * * * *